US007779771B2

(12) United States Patent
Immonen

(10) Patent No.: US 7,779,771 B2
(45) Date of Patent: Aug. 24, 2010

(54) METHOD FOR BREAKING ICE, MOTOR-DRIVEN WATERCRAFT AND ITS USE

(75) Inventor: Pauli Immonen, Masku (FI)

(73) Assignee: Mobimar Oy, Turku (FI)

( * ) Notice: Subject to any disclaimer, the term of this patent is extended or adjusted under 35 U.S.C. 154(b) by 189 days.

(21) Appl. No.: 12/092,807

(22) PCT Filed: Nov. 8, 2006

(86) PCT No.: PCT/FI2006/000358

§ 371 (c)(1),
(2), (4) Date: May 9, 2008

(87) PCT Pub. No.: WO2007/054607

PCT Pub. Date: May 18, 2007

(65) Prior Publication Data

US 2008/0276850 A1 Nov. 13, 2008

(30) Foreign Application Priority Data

Aug. 11, 2005 (FI) ..... 20051128

(51) Int. Cl.
*B63B 35/08* (2006.01)

(52) U.S. Cl. ..... 114/40; 114/61.1

(58) Field of Classification Search ..... 114/40–42, 114/61.1

See application file for complete search history.

(56) References Cited

U.S. PATENT DOCUMENTS 3,985,091 A 10/1976 Waas
4,436,046 A * 3/1984 Braley ..... 114/42
4,753,184 A 6/1988 Schiavone
6,932,012 B1 8/2005 Philips et al.

FOREIGN PATENT DOCUMENTS

| | | | |
|---|---|---|---|
| DE | 3240299 | A1 | 5/1983 |
| DE | 3514555 | A1 | 12/1985 |
| FI | 78432 | B | 4/1989 |
| JP | 55-29690 | A | 3/1980 |
| RU | 2171203 | C1 | 8/2000 |
| WO | 01/26262 | A1 | 5/2001 |
| WO | 01/36262 | A1 | 5/2001 |
| WO | 2007/045607 | A1 | 5/2007 |

OTHER PUBLICATIONS

WO 2007/054607 A1 published with Amended Claims (received by the International Bureau May 15, 2007).
International Preliminary Report on Patentability issued in PCT/FI2006/000358.
Search Report issued in PCT/FI2006/000358.

* cited by examiner

*Primary Examiner*—Stephen Avila
(74) *Attorney, Agent, or Firm*—Stiennon & Stiennon

(57) ABSTRACT

Ice is broken with a motor-driven watercraft with three hulls, i.e. a trimaran (4), having a middle hull (3), a propulsion device (9), a right (1) and a left (2) side hull and a deck (5). The three hulls are attached. Ice is broken with the middle hull (3) of the trimaran. The propulsion device (9) is arranged in the middle hull (3) and a keel (7) in the longitudinal direction of the middle hull is arranged in the bow (3*a*) of the bottom of the middle hull for breaking ice.

25 Claims, 2 Drawing Sheets

METHOD FOR BREAKING ICE, MOTOR-DRIVEN WATERCRAFT AND ITS USE

CROSS REFERENCES TO RELATED APPLICATIONS

This application is a U.S. national stage application of International App. No. PCT/FI2006/000358, filed Nov. 8, 2006, the disclosure of which is incorporated by reference herein, and claims priority on Finnish App. No. 20051128, filed Nov. 8, 2005.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The object of the invention is a method for breaking ice, a motor-driven trimaran and use of the trimaran for breaking ice.

By trimaran is meant a ship, boat or other watercraft, which has three hulls. In this application the terms middle hull and side hulls are used for the hulls. Trimarans are known both as sailing and motor vessels. The purpose of the three hulls of the trimaran is to increase the stability of the watercraft. Three hulls also make possible the formation of a large deck area.

Most of the prior art trimarans are not designed to move in icy conditions and they function very poorly in ice conditions. If one manages to break ice with the prior art trimaran, three separate grooves are easily formed in the ice and the broken ice fragments are packed between the hulls of the watercraft. Thereby the total breaking resistance becomes large. Most ice-breaking vessels have one hull, but for the purpose of the ice-breaking properties, decisions have to be made concerning their hull shapes, which decisions deteriorate the open water properties of the watercraft.

In patent publication RU 2171203 C1 is shown a trimaran, to the bow of which is attached a hydraulic ice-breaking apparatus. Ice-separating wedges, which open in the direction of the side hulls, are arranged in the middle hull of the watercraft. Hydrofoils are arranged between the middle and side hulls. Ice is cut at the front of the watercraft into suitably sized fragments with a hydraulic ice-cutting device. The water under the hulls is saturated with air and with the aid of the hydrofoils the trimaran is lifted onto the ice, after which the ice cut by the cutting device is crushed by the weight of the watercraft. This solution is very complicated, especially because it requires an ice-cutting device and an airbag to be attached to the bow of the trimaran. In addition, the trimaran with its ice-cutting apparatus according to the publication is poorly suited for other use than ice cutting.

SUMMARY OF THE INVENTION

It is an aim of the present invention to reduce or even eliminate the above-mentioned problems appearing in the prior art.

An aim of the invention is to achieve a method, in which ice can be broken with a trimaran and in which a remarkably small amount of energy is needed for breaking the ice.

It is also an aim of the invention to achieve a watercraft, which can move in icy conditions breaking ice and excellently also in open water and is especially stable in both circumstances.

It is also an aim of the invention to achieve a watercraft, which has a small wave formation resistance and friction resistance and a small total resistance when breaking ice.

It is a further aim of the invention to achieve an ice-breaking watercraft, which needs a remarkably small amount of energy for breaking ice.

The exemplary applications and advantages mentioned in this text apply, when applicable, to the method for breaking ice, the motor-driven trimaran and the use of the trimaran for breaking ice according to the invention, even though it is not always specifically pointed out.

In a typical method according to the invention for breaking ice with a motor-driven watercraft with three hulls, i.e. a trimaran, which comprises a middle hull, a propulsion device, a right and a left side hull and a deck, where the three hulls are attached, ice is broken with the middle hull of the trimaran. A great advantage of the method is that no separate ice-breaking device, which for example protrudes from the hull, is needed for breaking the ice, but the ice breaking is performed with the middle hull of the trimaran. The right side hull is on the right side of the middle hull when seen from the stern of the ship towards the bow and the left side hull is on the left side of the middle hull. In a manner typical for trimarans the side hulls are separate from the main hull, whereby the watercraft is especially stable.

In a method according to an embodiment of the invention, the low-gradient bow of the middle hull is arranged partly on the ice and the keel in the bow of the trimaran strikes the ice first and creates a line in it, where the ice starts to break, after which the bottom of the middle hull hits the ice and breaks it by pushing it significantly downwards so, that the ice breaks on an area which is significantly of the same width as the middle hull.

In a method according to an embodiment of the invention, the side hulls, which are situated further back than the middle hull in the longitudinal direction of the watercraft, hit the ice significantly later than the bow of the middle hull. It is easier for the side hulls to break the ice, when the middle hull has already before them broken a passage in the ice, which has the width of the middle hull.

In a method according to an embodiment of the invention, the side hulls are situated higher than the middle hull in the vertical direction of the watercraft. For this reason, the side hulls rise remarkably easily at least partly on top of ice and break the ice with a remarkably small amount of energy by bending the edges of the ice cover downwards, so that the side hulls do not need to break the ice by piercing the ice completely. The ice breaking resistance is thereby remarkably small. Because of the side hulls the watercraft is also very stable both in open water and in icy conditions.

In a method according to an embodiment of the invention, the side hulls bend down and thus break the ice which is left on the sides of the middle hull, so that a broken passage essentially of the width of the entire watercraft including the side hulls is formed in the ice.

In a method according to an embodiment of the invention, the side hulls bend down and thus break the ice without essentially piercing it. The side hulls are able to bend the ice downwards and get it to break essentially at their location with a remarkably small amount of energy, because the middle hull first breaks a passage of its own width in the ice, after which the edges of the ice field pressed by the side hulls have no support on the side of the middle hull in respect of the side hulls. The ice fragments bent down by the side hulls cannot get packed between the middle hull and the side hulls situated higher up, whereby the resistance when breaking ice remains remarkably small.

In a method according to an embodiment of the invention, the principal propulsive force of the trimaran is formed in the propulsion device situated in the middle hull. When the propulsion device is arranged in the middle hull, it can well come into contact with the water even in icy water and can effectively push off from the water, because the middle hull breaks the ice into sufficiently small fragments.

A typical motor-driven watercraft with three hulls according to the invention, i.e. a trimaran, comprises a middle hull, a propulsion device, a right and a left side hull and a deck, where the three mentioned hulls are attached. In a typical trimaran according to the invention the propulsion device is arranged in the middle hull and a keel in the longitudinal direction of the middle hull is arranged in the bow of the bottom of the middle hull for breaking ice. In addition to its ice-breaking properties the keel also protects and strengthens the bow and bottom of the watercraft. The watercraft according to the invention can move well both in icy conditions and in ice-free water and is especially stable in both. The deck area of the watercraft can be arranged remarkably large compared to watercrafts with one hull of a corresponding length.

According to a very advantageous embodiment of the invention, the keel is essentially at the same level as the side plates.

According to an embodiment of the invention the height of the keel is 40-100 mm, preferably 50-70 mm and the width is 20-60 mm, preferably 30-50 mm. According to an embodiment of the invention emphasized protruding part of the keel is arranged in the longitudinal direction of the ship to the part of the bow of the bottom of the middle hull, with which ice is primarily broken and which thereby hits the ice most when breaking ice. By the emphasized protruding part is meant that part, where the height of the keel from the bottom of the middle hull surrounding it is for example 40-100 mm or preferably 50-70 mm. In an application the emphasized protruding part of the keel starts approximately a meter above the water line and continues 2-8 meters backwards from the water line. According to an embodiment the keel has essentially the length of the entire hull. According to an application of the invention, a narrow keel has been arranged also to the bottom of both side hulls, which keel improves especially the ice bending properties.

In an application of the invention, the relationship between the length and the width of the middle hull of the trimaran is at least 5 or preferably 5-20, very preferably 6-15, especially preferably 7-10. The middle hull is thus remarkably long and narrow and among others because of this it and the whole watercraft have a small wave formation resistance and friction resistance. The trimaran according to an embodiment of the invention can in open water function with Froude numbers higher than 1. The total resistance of the narrow hull is small also when breaking ice. According to an application the length of the trimaran is 10-300 meters, according to another 10-200 meters and according to still one 100-300 meters. According to an application the length of the trimaran is 10-40 meters, preferably 11-30 meters. In an application the trimaran is approximately 18-22 m long and its maximum width is 9-11 m, whereby the width of the middle hull is 3-5 m, the width of the side hulls 0.5-1.5 m and the distance between the side hulls and the middle hull is 1.5-2 m.

In an application of the invention the bows of the side hulls are situated essentially further back than the bow of the middle hull in the longitudinal direction of the watercraft. The turning properties of the trimaran are especially good, when the side hulls are situated clearly further back than the middle hull. An especially advantageous property of the invention is that the trimaran, where the side hulls are situated essentially further back than the middle hull, can turn in the passage it has broken in the ice field and can thereby escape the passage. This kind of turning is often remarkably difficult with watercrafts with one hull capable of ice breaking, which watercrafts are generally steered back into the broken passage by the shape of the bow.

In an application of the invention the bottom of the middle hull is essentially lower than the bottoms of the side hulls in the vertical direction of the watercraft.

In an application of the invention the incidence angle of the bottom of the middle hull in relation to the water is 10-45° (degrees), preferably 13-25°, especially preferably 14-20°. Because of such a low-gradient angle of incidence, the bow of the watercraft easily rises partly onto the ice when breaking ice, after which the bow of the watercraft and the bottom of the front part push the ice sloping downwards and obliquely forwards in relation to the direction of motion, so that the ice breaks into fragments with a relatively small amount of energy.

In an application of the invention, the width of the middle hull decreases or stays the same in the longitudinal direction from the midpoint of the hull towards the stern. For this reason the ice cannot easily get packed between the middle hull and the side hulls. When breaking ice, the ice bent by the side hulls can anyway not easily get between the side hulls and the middle hull, because the side hulls are situated higher up than the middle hull and break the ice edge by bending it primarily downwards.

In an application of the invention the rears of the side hulls reach essentially to the same level as the rear of the middle hull in the longitudinal direction of the watercraft.

In an application of the invention the carrying capacity of the middle hull corresponds to 50-99% of the displacement of the watercraft, preferably 70-90%, especially preferably 80-90%. When the middle hull carries such a large part of the weight of the watercraft, the technology of the watercraft can primarily be concentrated into the middle hull. The middle hull with a large displacement can be made remarkably slender though it is long. Thus the wave resistance and the ice breaking resistance are small.

In an application of the invention the watercraft comprises in addition to a middle hull and a right and left side hull at least one hull so that the watercraft has for example 4, 5, 6 or 7 hulls. In an application of the invention the watercraft comprises in addition to a middle hull and a right and left side hull two subsidiary hulls, the bows of which are situated further back than the bows of the side hulls in the longitudinal direction of the watercraft. The right subsidiary hull is situated on the right side of the right side hull when seen from the stern of the watercraft towards the bow and the left subsidiary hull on the left side of the left side hull. When breaking ice the middle hull first breaks an area of the width of the middle hull in the ice. The right and the left side hull hit the ice later than the middle hull and bend down and thus break the ice left on the sides of the middle hull essentially at the width of the side hulls. Even later than the side hulls, the subsidiary hulls hit the ice bending more ice so that the width of the broken passage essentially corresponds to the distance of the subsidiary hulls from each other.

In a typical use according to the invention of the trimaran for breaking ice, the trimaran corresponds to one of the embodiments of the invention shown in this application.

The invention is described in more detail below with reference to the accompanying drawings.

DESCRIPTION OF THE PREFERRED EMBODIMENTS

Figure 1:
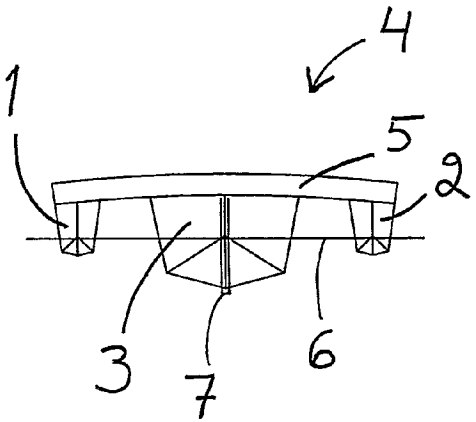
FIG. 1 shows as seen from the front, i.e. from the direction of the bow, a trimaran according to the first embodiment of the invention.

In FIG. 1 is shown as seen from the front, i.e. from the direction of the bow of the watercraft, a trimaran 4 according to the first embodiment of the invention, which trimaran comprises a middle hull 3, a right 1 and a left 2 side hull and a deck 5, where all three hulls 1, 2, 3 are attached. The middle hull 3 forms the main hull of the watercraft 4 and in accordance with the figure it is wider than the side hulls 1, 2 and carries the largest part of the displacement of the watercraft 4, in this example approximately 85%. The side hulls 1, 2 are in the vertical direction higher up than the middle hull 3 and do therefore not swim so deep in the water, but they make the watercraft 4 very stable. In the figure, the water surface is marked with number 6. From the figure can also be seen a very large deck 5, which is one of the advantages of the trimaran according to the invention in comparison to watercrafts with one hull. In the bow part of the bottom of the middle hull 3, essentially in the middle in the lateral direction of the watercraft, is a keel 7, which especially well boosts the breaking of the ice.

Figure 2:
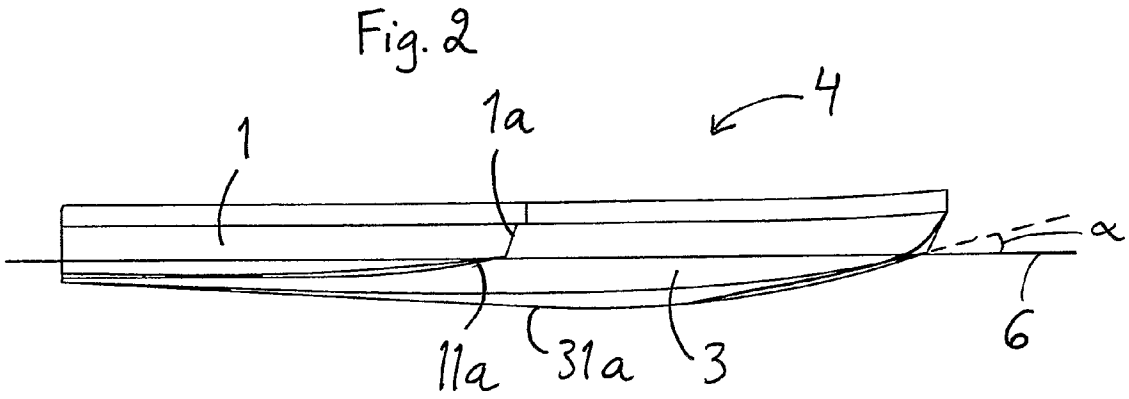
FIG. 2 shows the trimaran according to the first embodiment of the invention as seen from the side.

FIG. 2 shows the trimaran 4 of the first embodiment of the invention as seen from the side. From the figure can be seen that the incidence angle $\alpha$ of the bottom of the middle hull 3 in relation to the water surface is remarkably low-gradient, in this example about 20°. Because of its low-gradient incidence angle, the front end of the middle hull rises partly onto the ice in icy conditions and breaks the ice by pushing it downwards, whereby the amount of energy needed for the breaking is remarkably smaller than in a case where the ice would be rammed to pieces essentially in the direction of the water surface 6. The side hull 1 is situated so in relation to the middle hull 3 that the bow 1*a* of the side hull is in the longitudinal direction essentially further back than the bow of the middle hull, in this example by the midpoint of the middle hull. The bow part 11*a* of the bottom of the side hull 1 is remarkably higher up than the bottom 31*a* of the midpoint of the middle hull, which is situated at the same point in the longitudinal direction of the watercraft 4. The incidence angle of the side hulls 1 in relation to the water surface 6 is also approximately as low-gradient as that of the middle hull 3, wherefore also the side hulls 1 easily rise partly onto the ice in icy conditions and bend down and thus break the ice underneath them. Also the location of the side hulls 1 higher up than the middle hull 3 helps the side hulls 1 get partly onto the ice and stay partly on the ice.

Figure 3:
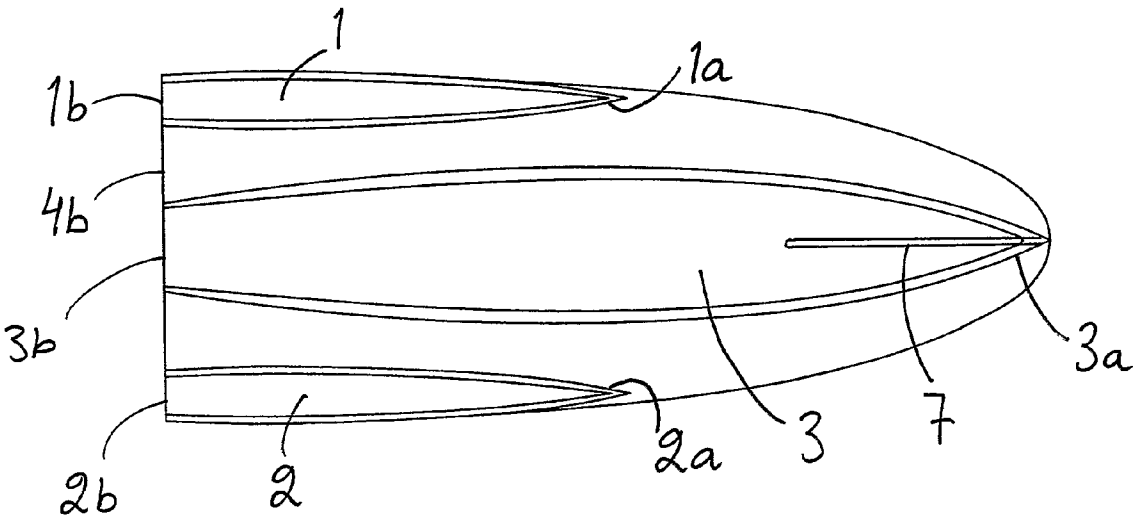
FIG. 3 shows the trimaran according to the first embodiment of the invention as seen from below, i.e. from the bottom of the ship.

FIG. 3 shows the trimaran according to the first embodiment of the invention as seen from below, i.e. from the bottom of the ship. All three hulls 1, 2, 3 are shaped essentially long and slender. The relationship between the length and the width of the middle hull 3 is approximately sextuple. From the figure can be seen that the middle hull 3 is at its widest at the midpoint in its longitudinal direction, i.e. approximately at the same point, where the bows 1*a*, 2*a* of the side hulls are situated. In this example the width of the middle hull 3 decreases in the longitudinal direction from the midpoint towards the stern 3*b*. The space between the middle hull 3 and the side hulls 1, 2 does not get essentially narrower in the direction of the water surface when moving from the point of the bows 1*a*, 2*a* of the side hulls towards the stern 4*b* of the watercraft. Among others because of this design, ice cannot accumulate between the middle hull and the side hulls.

Figure 4:
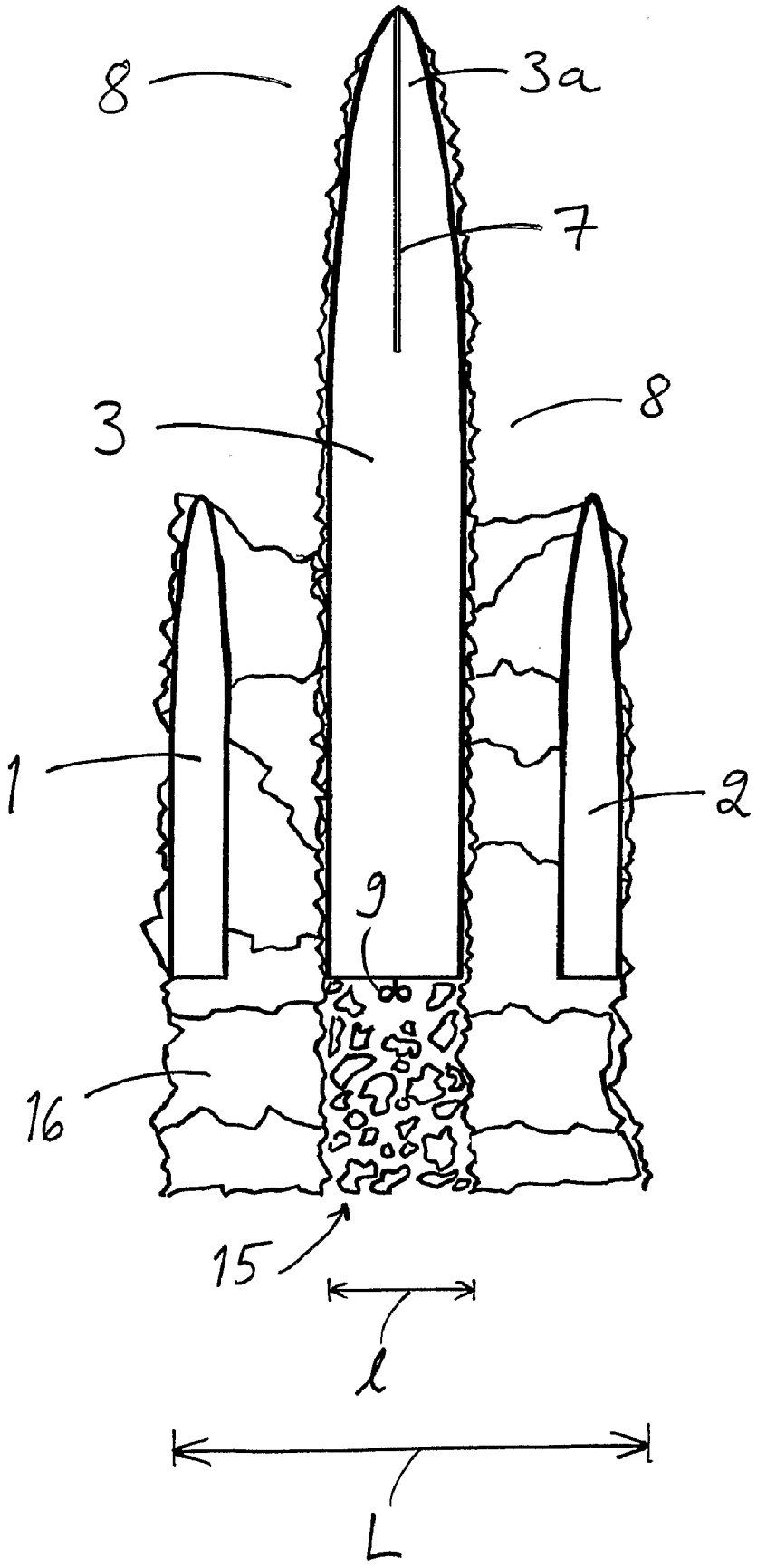
FIG. 4 shows a situation, where a trimaran according to the second embodiment of the invention is breaking ice.

FIG. 4 shows a situation, where the trimaran according to the second embodiment of the invention is breaking ice 8. The figure is shown as seen from above the trimaran. The figure shows only the three hulls 1, 2, 3 of the trimaran, but not the deck, in order to make the figure as clear as possible. From the figure can be seen that the bow 3*a* of the middle hull of the trimaran, and the keel 7, which is emphasized protruding especially in the bow part of the bottom, are first to hit the ice 8 to be broken. The keel 7 is shown in the figure so that it can be seen through the middle hull 3. The middle hull 3 breaks a passage in the ice 8 essentially of the width of the middle hull. The middle hull breaks the ice into small fragments so that the propulsion device 9 situated in the rear part of the middle hull can efficiently push off from the water. The side hulls 1, 2, which are situated further back than the middle hull in the longitudinal direction of the watercraft, hit the ice 8 significantly later than the bow 3*a* of the middle hull. Typically the side hulls 1, 2 are situated higher up than the middle hull 3 in the vertical direction of the watercraft, wherefore the side hulls do not as such completely go through the ice but they only push the ice 8 downwards so that the ice is bent down and thus broken approximately at the point of the side hulls 1, 2. The ice is bent in the mentioned manner relatively easily and with a small amount of energy, because the ice edge which is pushed downwards has no steady support on the side of the middle hull 3 as seen from the side hull 1, 2. From the figure can be seen that the middle hull breaks the ice into small fragments 15, but the ice sections 16, which are broken by the side hulls by bending, remain larger, but are still separate so that a watercraft with a width which is as large or smaller than the width L of the broken passage can easily move in the passage broken by the trimaran without breaking ice.

Although especially the ice breaking ability of the trimaran according to the invention has been emphasized in this application, it should be noticed that the trimaran according to the invention also works excellently in open water.

The figures show preferable applications of the invention. They do not separately show matters that are irrelevant in view of the main idea of the invention, known as such or obvious as such for a man skilled in the art. It is apparent to a man skilled in the art that the invention is not limited exclusively to the examples described above, but that the invention can vary within the scope of the claims presented below. The dependent claims present some possible embodiments of the invention, and they are not to be considered to restrict the scope of protection of the invention as such.

The invention claimed is:

1. A method for breaking ice with a motor-driven watercraft with three hulls, i.e. a trimaran, comprising a middle hull having, a bow, a propulsion device, a right side hull and a left side hull and a deck, wherein said three hulls extend in a longitudinal direction and are attached to define a whole width of said trimaran, comprising the steps of:

ice breaking by hitting the ice with the bow of the middle hull of the trimaran, leaving ice on either side of the middle hull;

followed by hitting the ice with the right side hull, and the left side hull, which are situated further back than the middle hull in the longitudinal direction of the watercraft so that the hitting of the ice by the right side hull, and the left side hull takes place substantially later than ice breaking by the bow of the middle hull; and wherein the right side hull, and the left side hull, bend down and thus break the ice that is left on the sides of the middle hull, so that a broken passage having essentially the width of the whole watercraft including the side hulls, is formed in the ice.

2. The method of claim 1, wherein in the step of hitting the ice with the bow of the middle hull, the middle hull has a bottom which extends to a low-gradient bow which is arranged partly on the ice and the middle hull has a keel mounted to the bottom of the bow which strikes the ice first and creates a line in the ice, so that the ice starts to break, after which the bottom of the middle hull hits the ice and breaks it by pushing it significantly downwards so that the ice breaks in an area which is substantially of the same width as the middle hull.

3. The method of claim 1 wherein the right side hull, and the left side hull are situated higher up than the middle hull in a vertical direction with respect to the watercraft.

4. The method of claim 1 wherein the right side hull, and the left side hull bend down the ice and thus break the ice without essentially piercing the ice.

5. The method of claim 1 wherein the trimaran is propelled by a main propulsive force produced with a propulsion device situated in the middle hull.

6. A motor driven ice breaker having three hulls in a trimaran arrangement, comprising:

a middle hull having a bow and a propulsion device;

a right side hull;

a left side hull;

a deck joining the middle hull to the right side hull and the left side hull, wherein said three hulls extend in a longitudinal direction and are attached to define a width of said trimaran;

the middle hull forming a first means for ice breaking by hitting ice with the bow to leave the ice on either side of the middle hull;

the right side hull, and the left side hull forming a second means for hitting the ice further back than the middle hull in the longitudinal direction so that the right side hull, and the left side hull hit the ice after the middle hull and break the ice that is on the sides of the middle hull, so that a broken passage having essentially the width of the whole ice breaker including the side hulls, is formed in the ice; and wherein the right side hull, and the left side hull are situated higher up than the middle hull in a vertical direction with respect to the ice breaker and wherein second means for hitting the ice further back than the middle hull further comprises a means for bending down the ice and thus for breaking the ice without essentially piercing the ice.

7. The ice breaker of claim 6, wherein the middle hull has a bottom which extends to a low-gradient bow which is arranged to extend partly onto the ice and the middle hull has a keel mounted to the bottom of the bow, which is arranged to strike the ice first, wherein the first means includes a means for creating a line in the ice with the keel so that the ice starts to break and is pushed significantly downwards so that the ice breaks in an area which is substantially of the same width as the middle hull.

8. The ice breaker of claim 7 wherein the ice breaker has a main propulsion device situated in the middle hull.

9. The ice breaker of claim 7 wherein the middle hull has a length in the longitudinal direction, and a width transverse to the longitudinal direction and wherein the length is 7-10 times the width.

10. The ice breaker of claim 6, wherein the middle hull has a bow, a stern, a bottom, and a bow part of the bottom, and a keel extending in the longitudinal direction of the middle hull and arranged at the bow part of the bottom for breaking the ice, wherein the second means for hitting the ice is formed by the right side hull having a right side bow, and the left side hull having a left side bow.

11. The ice breaker of claim 10, wherein the keel is essentially on the same level as the side plates.

12. The ice breaker of claim 10 wherein the middle hull has a length in the longitudinal direction, and a width transverse to the longitudinal direction and wherein the length is greater than 5 times the width.

13. The ice breaker of claim 10 wherein the middle hull has a length in the longitudinal direction, and a width transverse to the longitudinal direction and wherein the length is 5-20 times the width.

14. The ice breaker of claim 10 wherein the middle hull has a length in the longitudinal direction, and a width transverse to the longitudinal direction and wherein the length is 6-15 times the width.

15. The ice breaker of claim 10 wherein the middle hull has a length in the longitudinal direction, and a width transverse to the longitudinal direction and wherein the length is 7-10 times the width.

16. The ice breaker of claim 10, wherein the bottom of the middle hull is situated essentially lower than the bottoms of the side hulls in a vertical direction of the trimaran.

17. The ice breaker of claim 10, wherein the incidence angle of the bottom of the middle hull in relation to a water surface over which the ice breaker moves is 10-45°.

18. The ice breaker of claim 10, wherein the incidence angle of the bottom of the middle hull in relation to a water surface over which the ice breaker moves is 13-25°.

19. The ice breaker of claim 10, wherein the incidence angle of the bottom of the middle hull in relation to a water surface over which the ice breaker moves is 14-20°.

20. The ice breaker of claim 12, wherein the width of the middle hull decreases or stays the same in the longitudinal direction at the midpoint of the hull toward the stern.

21. The ice breaker of claim 10, wherein the ice breaker defines a displacement, and the middle hull has a carrying capacity corresponding to 50-99% of the displacement of the ice breaker.

22. The ice breaker of claim 10, wherein the ice breaker defines a displacement, and the middle hull has a carrying capacity corresponding to 70-90%, of the displacement of the ice breaker.

23. The ice breaker of claim 10, wherein the ice breaker defines a displacement, and the middle hull has a carrying capacity corresponding to 80-90% of the displacement of the ice breaker.

24. A method of breaking ice comprising breaking ice with the ice breaker of claim 10.

25. A method for breaking ice with a motor-driven ice breaker with three hulls forming a trimaran, comprising a middle hull having a bottom leading to a bow, a propulsion device, a right side hull and a left side hull and a deck, wherein said three hulls extend in a longitudinal direction and are attached to define a whole width of said trimaran, and the right and left side hulls are situated higher than the middle hull in the vertical direction, comprising the steps of:

ice breaking by hitting the ice with the bow of the middle hull of the trimaran, so that the bow which extends in a low-gradient is arranged partly on the ice so that a keel mounted to the bottom of the bow strikes the ice first and creates a line in the ice and starts to break the ice, after which the bottom of the middle hull hits the ice and breaks it by pushing it significantly downwards so that the ice breaks in an area which is substantially of the same width as the middle hull leaving ice edges on either side of the middle hull;

followed by breaking the ice with the right side hull, and the left side hull, which are situated further back than the middle hull in the longitudinal direction of the water-craft; and wherein the right side hull, and the left side hull, side hulls rise at least partly on top of ice and break the ice by bending the edges of the ice downward.

* * * * *

UNITED STATES PATENT AND TRADEMARK OFFICE

CERTIFICATE OF CORRECTION

PATENT NO. : 7,779,771 B2
APPLICATION NO. : 12/092807
DATED : August 24, 2010
INVENTOR(S) : Pauli Immonen It is certified that error appears in the above-identified patent and that said Letters Patent is hereby corrected as shown below:

Title Pg, Item (30) Foreign Application Priority Data, the date "Aug. 11, 2005" should be --Nov. 8, 2005--.

Column 8, line 4, "The ice breaker of claim 7" should be --The ice breaker of claim 6--.

Column 8, line 6, "The ice breaker of claim 7" should be --The ice breaker of claim 6--.

Signed and Sealed this
Nineteenth Day of July, 2011

David J. Kappos

David J. Kappos
*Director of the United States Patent and Trademark Office*